US009703272B2

(12) United States Patent
Fraser et al.

(10) Patent No.: US 9,703,272 B2
(45) Date of Patent: Jul. 11, 2017

(54) APPARATUS WITH RADIATING ELEMENT ISOLATED FROM AN ELECTRICALLY CONDUCTIVE WEARABLE APPARATUS CARRIER DEVICE

(71) Applicant: Google Technology Holdings LLC, Mountain View, CA (US)

(72) Inventors: Nicholas A. Fraser, Grayslake, IL (US); Thomas E. Gitzinger, Libertyville, IL (US); Dickon Isaacs, Chicago, IL (US); Michael F. Paradise, Chicago, IL (US); Michael E. Russell, Lake Zurich, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 339 days.

(21) Appl. No.: 14/476,319

(22) Filed: Sep. 3, 2014

(65) Prior Publication Data

US 2015/0378321 A1 Dec. 31, 2015

Related U.S. Application Data

(60) Provisional application No. 62/017,093, filed on Jun. 25, 2014.

(51) Int. Cl.
*G04G 21/04* (2013.01)
*G04G 17/04* (2006.01)

(52) U.S. Cl.
CPC ..... *G04G 21/04* (2013.01); *G04G 17/04* (2013.01)

(58) Field of Classification Search
CPC ..... G04G 21/04
USPC ..... 343/718
See application file for complete search history.

(56) References Cited

U.S. PATENT DOCUMENTS 5,331,608 A * 7/1994 Umemoto ..... G04G 21/04 368/10
2007/0091004 A1* 4/2007 Puuri ..... H01Q 13/10 343/718
2012/0120772 A1* 5/2012 Fujisawa ..... G04C 10/02 368/64

OTHER PUBLICATIONS

Sony: SmartWatch 2—Metal Band, http://store.sony.com/smartwatch-2-metal-band-zid27-SW2MET/cat-27-catid-SmartWatch, downloaded from the Internet: Sep. 3, 2014, all pages.

* cited by examiner

*Primary Examiner* — Dameon E Levi
*Assistant Examiner* — Andrea Lindgren Baltzell
(74) *Attorney, Agent, or Firm* — Faegre Baker Daniels LLP

(57) ABSTRACT

A wearable apparatus can include a transceiver. The apparatus can include an electrically conductive housing, the transceiver carried in the housing, the housing including at least a first wearable apparatus carrier device connection area. The apparatus can include a radiating element, the radiating element connected to the housing, the radiating element coupled to a feed point that is coupled to the transceiver, and the radiating element configured to radiate radio frequency signals. The apparatus can include a current isolation element. The apparatus can include an electrically conductive wearable apparatus carrier device coupled to the electrically conductive housing via the current isolation element, where the current isolation element provides electrical isolation between the electrically conductive wearable apparatus carrier device and the electrically conductive housing and/or the radiating element.

17 Claims, 15 Drawing Sheets

APPARATUS WITH RADIATING ELEMENT ISOLATED FROM AN ELECTRICALLY CONDUCTIVE WEARABLE APPARATUS CARRIER DEVICE

CROSS-REFERENCE TO RELATED APPLICATIONS

This application is related to and claims the benefit of under 35 U.S.C. §119(e) from an application entitled "APPARATUS WITH RADIATING ELEMENT ISOLATED FROM AN ELECTRICALLY CONDUCTIVE WEARABLE APPARATUS CARRIER DEVICE," U.S. Provisional Patent Application No. 62/017,093 filed Jun. 25, 2014, and is related to an application entitled "AN ANTENNA SYSTEM AND METHOD OF ASSEMBLY FOR A WEARABLE ELECTRONIC DEVICE," application Ser. No. 14/339,476, filed Jul. 24, 2014, both commonly assigned to the assignee of the present application and hereby incorporated by reference.

BACKGROUND

1. Field

The present disclosure is directed to an apparatus with a radiating element isolated from an electrically conductive wearable apparatus carrier device. More particularly, the present disclosure is directed to isolating an electrically conductive wearable apparatus carrier device from a device radiating element.

2. Introduction

Presently, wearable wireless devices, such as smart watches, smart glasses, chest heart rate monitors, and other wearable devices, communicate with portable electronic devices, such as smartphones, cellular phones, and tablet computers, using wireless communication signals. This allows a user to use a device, such as a smart watch, to control functions of a portable electronic device, such as by placing and answering calls and playing music, and allows the smart watch to display information from the portable electronic device, such as a caller identifier information, messages, alerts, and other information. To communicate with a portable electronic device using wireless communication signals, a smart watch must include a transceiver attached to an antenna that sends and receives radio frequency signals to and from the portable electronic device.

Unfortunately, due to the small size of a smart watch or other wearable device, it is difficult to incorporate all of the desired components including the antenna within the smart watch.

BRIEF DESCRIPTION OF THE DRAWINGS

In order to describe the manner in which advantages and features of the disclosure can be obtained, a description of the disclosure is rendered by reference to specific embodiments thereof which are illustrated in the appended drawings. These drawings depict only example embodiments of the disclosure and are not therefore to be considered to be limiting of its scope.

DETAILED DESCRIPTION

Embodiments provide an apparatus with a housing radiating element isolated from an electrically conductive apparatus carrier. According to a possible embodiment, the apparatus can be a wearable apparatus. The apparatus can include a transceiver. The apparatus can include an electrically conductive housing, the transceiver carried in the housing, the housing including at least a first wearable apparatus carrier device connection area. The apparatus can include a radiating element, the radiating element connected to the housing, the radiating element coupled to a feed point that is coupled to the transceiver, and the radiating element configured to radiate radio frequency signals. The apparatus can include a current isolation element coupled to the radiating element at the first wearable apparatus carrier device connection area. The apparatus can include an electrically conductive wearable apparatus carrier device coupled to the electrically conductive housing via the current isolation element, where the current isolation element can provide electrical isolation between the electrically conductive wearable apparatus carrier device and the radiating element and/or increase the spacing between an electrically conductive components and an electrically conductive band. Otherwise, when a watch housing provides part of an antenna, the antenna may not operate efficiently when used with electrically conductive wearable apparatus carrier device, such as a metal watch band, because the metal watch band could short out or retune the antenna, and decrease, if not ruin, the antenna's ability to efficiently radiate radio frequency communication signals.

According to another possible embodiment, the apparatus can include a transceiver. The apparatus can include a watch housing including a watch housing radiating element. The watch housing radiating element can include a feed point coupled to the transceiver. The watch housing radiating element can cover the transceiver and can be configured to radiate radio frequency signals. The watch housing radiating element can also include a radiating aperture. The watch housing can additionally include a first watch band connection area and a second watch band connection area on an opposite side of the watch housing from the first watch band connection area. The apparatus can include a current isolation element coupled to the watch housing radiating element at the first watch band connection area. The apparatus can include an electrically conductive watch band coupled to the watch housing radiating element via the current isolation element. The current isolation element can isolate the electrically conductive watch band from at least some current from the watch housing radiating element.

Figure 1:
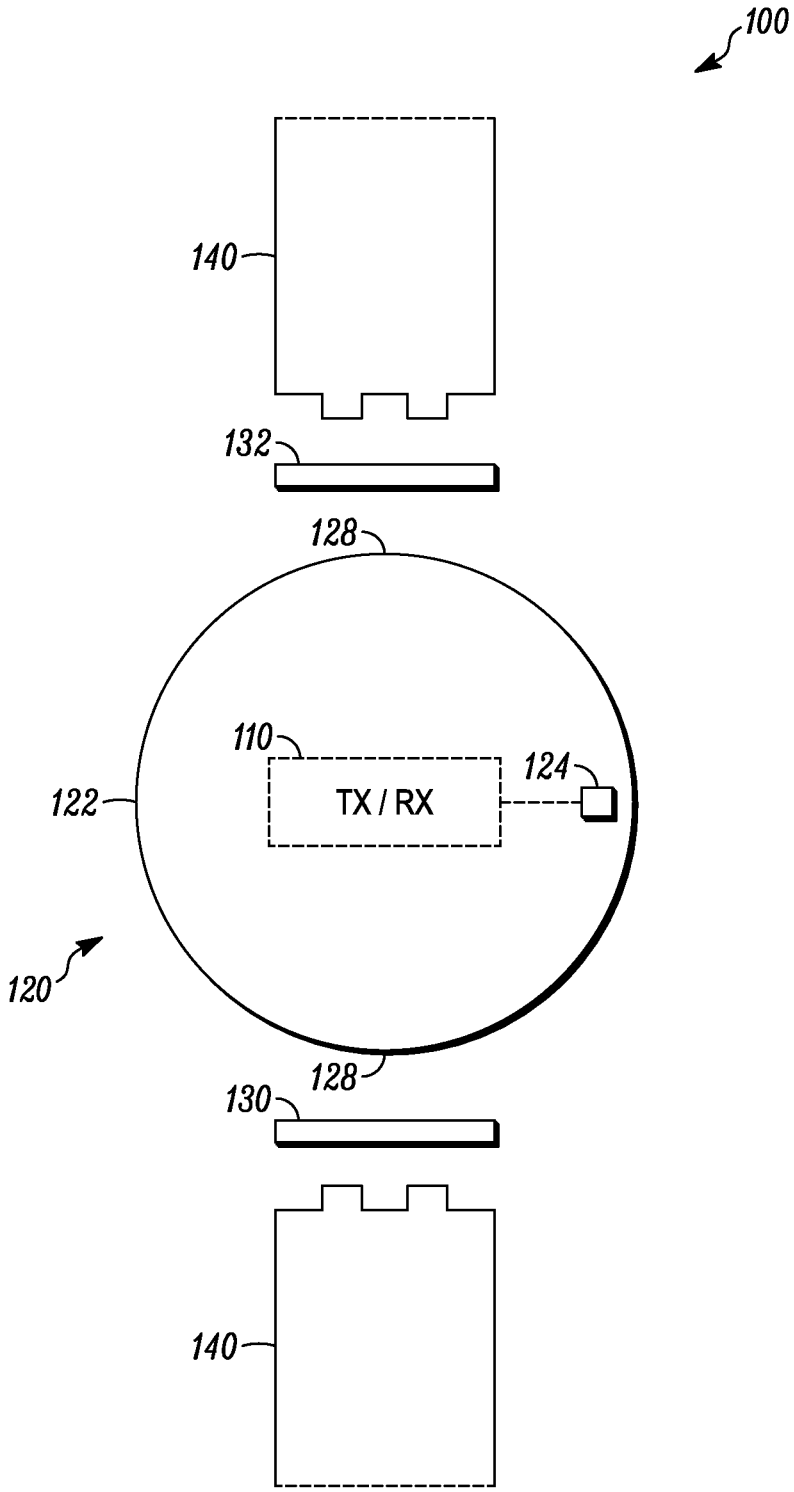
FIG. 1 is an example exploded view of elements of an apparatus according to a possible embodiment.

FIG. 1 is an example exploded view of an apparatus 100 according to a possible embodiment. The apparatus 100 can be a watch, a smart watch, a wrist heart rate monitor, a chest heart rate monitor, a lanyard electronic device, or any other apparatus that can employ a band or other wearable apparatus carrier device to be worn by a user. The apparatus 100 can include a transceiver 110. The apparatus 100 can include a watch housing 120 including a watch housing radiating element 122. The watch housing radiating element 122 can include a feed point 124 coupled to the transceiver 110. The watch housing radiating element 122 can be configured to radiate radio frequency signals. For example, the watch housing radiating element 122 can radiate near field wireless communication signals, such as Bluetooth® signals, can radiate Wireless Local Area Network (WLAN) wireless communication signals, can radiate cellular communication signals, and/or can radiate other wireless radio frequency communication signals. The watch housing radiating element 122 can cover the transceiver 110. The watch housing 120 can also include a first watch band connection area 126 and a second watch band connection area 128 on an opposite side of the watch housing 120 from the first watch band connection area.

The apparatus 100 can include a current isolation element 130 coupled to the watch housing radiating element 122 at the first watch band connection area 126. The apparatus 100 can include an electrically conductive watch band 140 coupled to the watch housing radiating element 122 via the current isolation element 130. The electrically conductive watch band 140 can be made of metal or any other electrically conductive material. The current isolation element 130 can isolate the electrically conductive watch band 140 from at least some current from the watch housing radiating element 122.

For example, the current isolation element 130 can isolate the electrically conductive watch band 140 from at least some of the electrical current from the watch housing radiating element 122 by attenuating, such as reducing, and/or blocking electrical current from being received by the electrically conductive watch band 140 and/or by preventing the watch housing radiating element 122 from shorting on the electrically conductive watch band 140. To do so, the current isolation element 130 can prevent contact between the electrically conductive watch band 140 and the watch housing radiating element 122. Alternatively, the current isolation element 130 can space the electrically conductive watch band 140 from the radiating element 122, to reduce re-tuning from a metal watch band. For example, the current isolation element 130 can be a plastic link, can be a housing protrusion, or can be any other section of the watch housing 120 or element that isolates the electrically conductive watch band 140 from current from the watch housing radiating element 122 and/or limits rotation of the electrically conductive watch band 140 to prevent it from electrically shorting with the watch housing radiating element 122. In particular, the current isolation element 130 can also minimize rotation of the electrically conductive watch band 140 with respect to the apparatus 100 to prevent the electrically conductive watch band 140 from contacting and shorting out on the watch housing radiating element 122. As another example, the current isolation element 130 can be a plastic link configured to keep the electrically conductive watch band 140 at least 0.5 mm away from the watch housing radiating element 122.

The apparatus 100 can also include another current isolation element 132 coupled to the watch housing radiating element 122 at the second watch band connection area 128. Another end of the electrically conductive watch band 140 can be coupled to the watch housing radiating element 122 via the current isolation element 132 and the current isolation element 132 can isolate the electrically conductive watch band 140 from at least some current from the watch housing radiating element 122.

Figure 2:
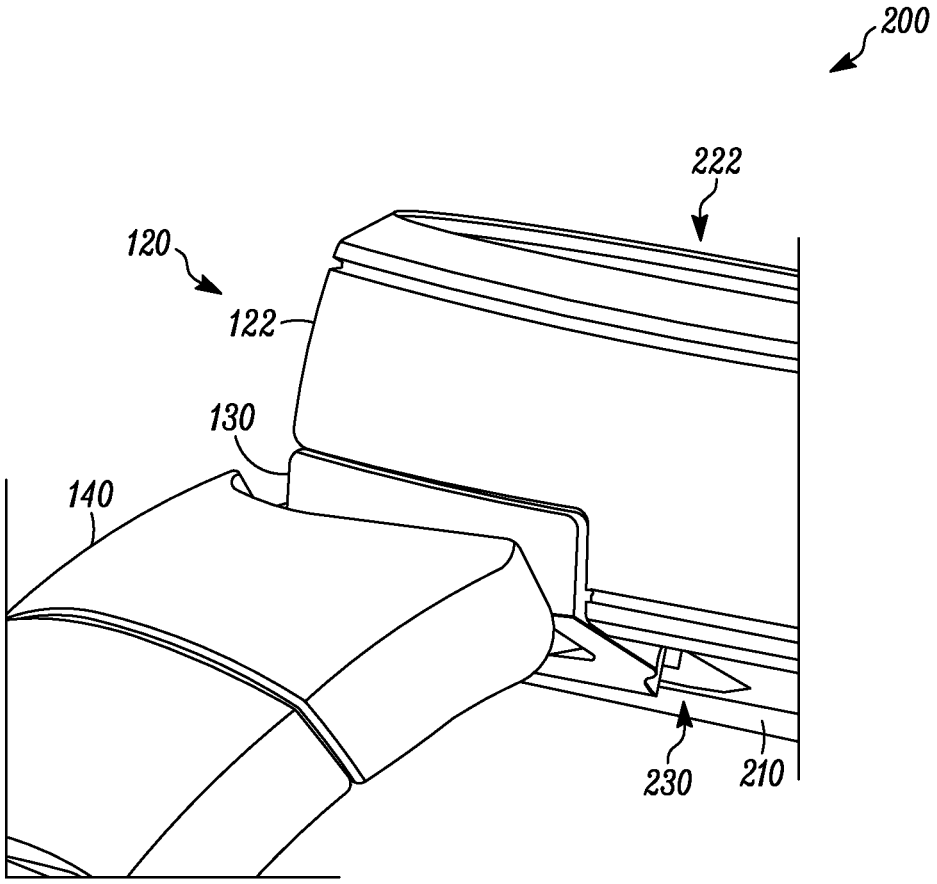
FIG. 2 is an example illustration of a section of an apparatus according to a possible embodiment.

FIG. 2 is an example illustration of a section 200 of the apparatus 100 according to a possible embodiment. The section 200 shows the watch housing 120 including the watch housing radiating element 122, the current isolation element 130, and the electrically conductive watch band 140. The watch housing 120 can include a front watch housing 222, defining a watch face, and configured to face away from a user's body when worn, where the front watch housing 222 can provide or operate with the watch housing radiating element 122. The watch housing 120 can also include a back watch housing 210 opposite from the front watch housing 222, where the back watch housing 210 can be configured to face a wrist of a user. The back watch housing 210 can include different layers, such as by including a decorative layer (not shown) over the back watch housing 210. Where the front housing is conductive, the back housing may, for example, be electrically non-conductive. The watch housing 120 can also include a housing pocket 230, such as the first watch band connection area 126. At least a portion of the current isolation element 130 and a portion of the electrically conductive watch band 140 can be inserted into the housing pocket 230. The housing pocket 230 can be in the front housing watch housing 222, can be in the back watch housing 210, or can be elsewhere on the watch housing 120.

The electrically conductive housing can include a housing pocket comprising the first wearable apparatus carrier device connection area, where at least the current isolation element is inserted into the housing pocket. The electrically conductive wearable apparatus carrier device can include the current isolation element at the end, or ends of a conductive portion, and the current isolation elements can be inserted into the housing pocket. Alternatively, the electrically conductive wearable apparatus carrier device can be inserted in the isolation member, which is inserted within the housing pocket.

Figure 3:
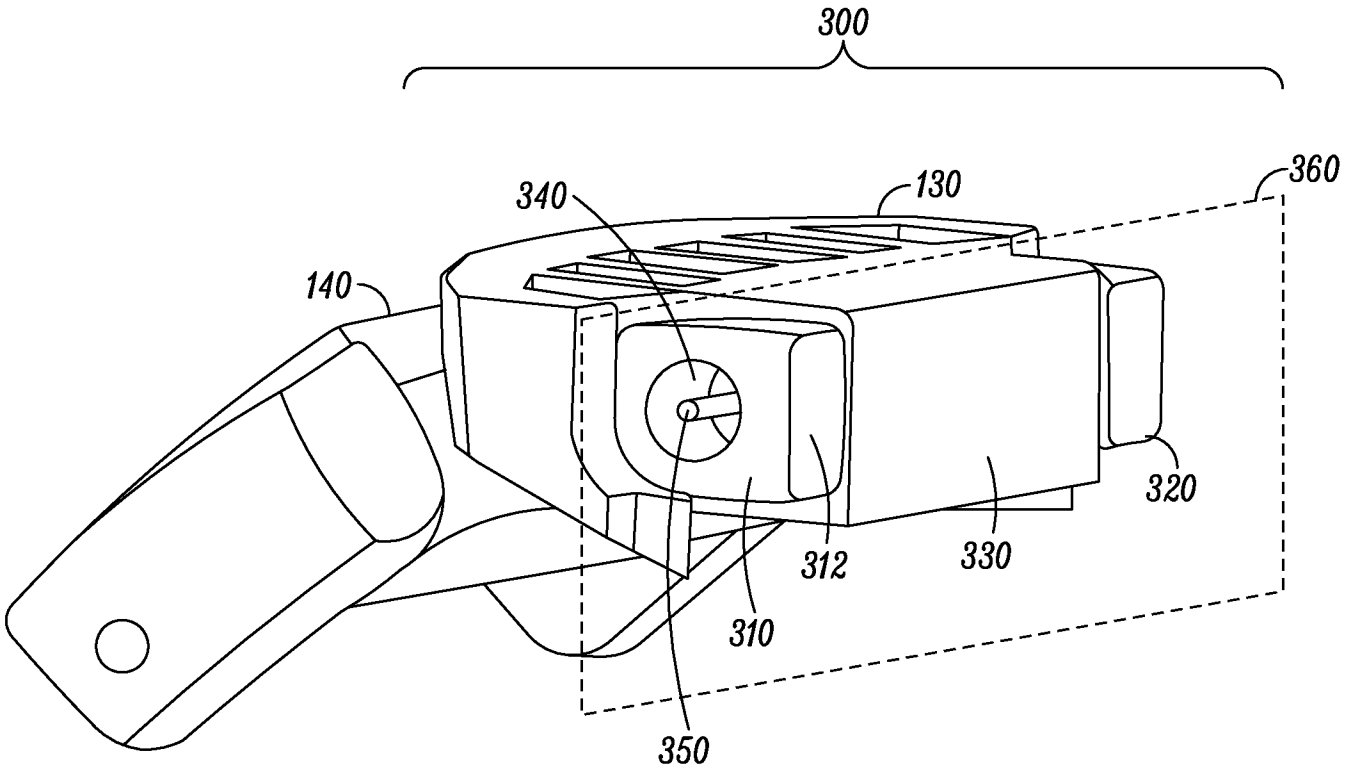
FIG. 3 is an example illustration of sections of an apparatus in a housing pocket according to a possible embodiment.

FIG. 3 is an example illustration of sections 300 of the apparatus 100 that can reside within the housing pocket 230 of FIG. 2 according to a possible embodiment. The housing pocket 230 of the watch housing 120 of FIG. 2 can include a flat section 360, such as a wall section, within the housing pocket 230. A side 330 of the current isolation element 130 in the housing pocket 230 and at least one side 312 of the portion of the electrically conductive watch band 140 in the housing pocket 230 can be flat and can couple with the housing pocket flat section 360 to limit rotation with respect to the watch housing radiating element 122 of FIG. 2. Additionally, at least a portion of the current isolation element 130 can cover a portion of the electrically conductive watch band 140. For example, the portion of the electrically conductive watch band 140 can include a first arm 310 and a second arm 320 that extend through the current isolation element 130. Two or more arms can be used instead of a single solid piece of the electrically conductive watch band 140 to reduce the amount electrically conductive material of the electrically conductive watch band 140 within the watch housing 120.

Figure 4:
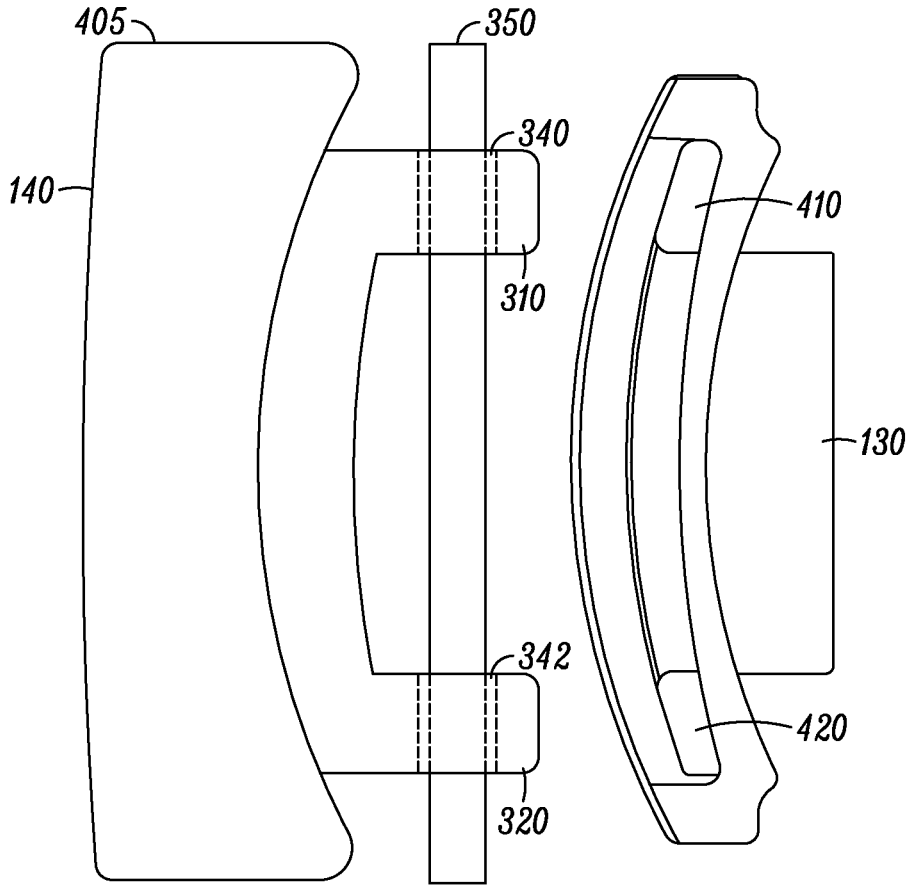
FIG. 4 is an example illustration of a section of a link of an electrically conductive watch band and a current isolation element according to a possible embodiment.

FIG. 4 is an example illustration of a section of a link 405 of the electrically conductive watch band 140 and of the current isolation element 130 according to a possible embodiment, which will be described in conjunction with FIG. 3. The first arm 310 can include a first aperture 340 and the second arm 320 can include a second aperture 342. A bar 350, such as a spring bar, can extend through the first aperture and the second aperture to secure the watch 140 band to the housing 120. The current isolation element 130 can also include a first isolation element aperture 410 and a second isolation element aperture 420. The first arm 310 can extend into the first isolation element aperture 410 and the second arm 320 can extend into the second isolation element aperture 420 to secure the electrically conductive watch band 140 to the current isolation element 130 and the housing 120.

Figure 5:
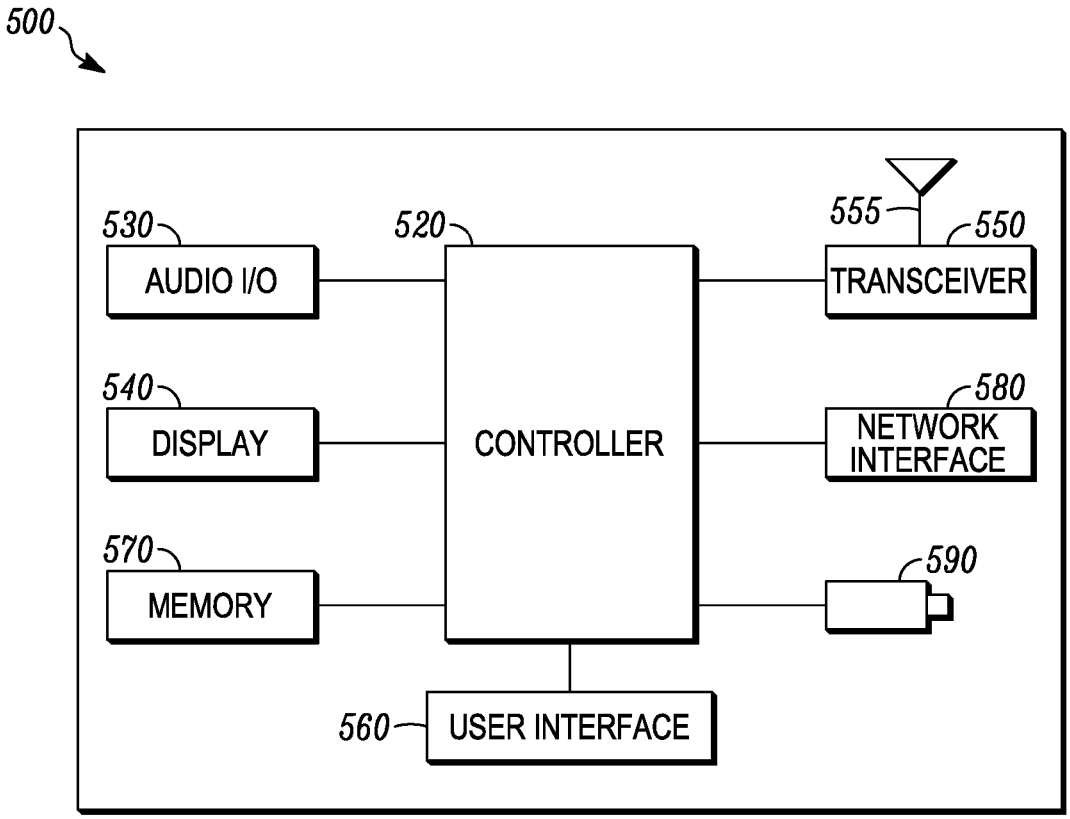
FIG. 5 is an example block diagram of electrically functional components of an apparatus according to a possible embodiment.

FIG. 5 is an example block diagram of electrically functional components of an apparatus 500, such as the apparatus 100, according to a possible embodiment. The apparatus 500 can include a housing 510, a controller 520 within the housing 510, audio input and output circuitry 530 coupled to the controller 520, a display 540 coupled to the controller 520, a transceiver 550, such as the transceiver 110, coupled to the controller 520, an antenna 555, such as the watch housing radiating element 122, coupled to the transceiver 550, a user interface 560 coupled to the controller 520, a memory 570 coupled to the controller 520, a network interface 580 coupled to the controller 520, and a vibrator 590 coupled to the controller 520. The apparatus 100 may include some or all of the components of the apparatus 500.

The display 540 can be a liquid crystal display (LCD), a light emitting diode (LED) display, a plasma display, a projection display, a touch screen, or any other device that displays information. The transceiver 550 may include a transmitter and/or a receiver. The audio input and output circuitry 530 can include a microphone, a speaker, a transducer, or any other audio input and output circuitry. The user interface 560 can include a keypad, a keyboard, buttons, a touch pad, a joystick, a touch screen display, another additional display, a camera, or any other device useful for providing an interface between a user and an electronic device. The network interface 580 can be a Universal Serial Bus (USB) port, an Ethernet port, an infrared transmitter/receiver, an IEEE 1394 port, or any other interface that can connect an apparatus to a network or computer and that can transmit and receive data communication signals. The memory 570 can include a random access memory, a read only memory, an optical memory, a subscriber identity module memory, a flash memory, a removable memory, a hard drive, a cache, or any other memory that can be coupled to a wireless communication device.

The apparatus 500 or the controller 520 may implement any operating system, such as Microsoft Windows®, UNIX®, or LINUX®, Android™, or any other operating system. Apparatus operation software may be written in any programming language, such as C®, C++®, Java® or Visual Basic®, for example. Apparatus software may also run on an application framework, such as, for example, a Java® framework, a .NET® framework, or any other application framework. The software and/or the operating system may be stored in the memory 570 or elsewhere on the apparatus 500. The apparatus 500 or the controller 520 may also use hardware to implement operations. For example, the controller 520 may be any programmable processor. Disclosed embodiments may also be implemented on a general-purpose or a special purpose computer, a programmed microprocessor or microprocessor, peripheral integrated circuit elements, an application-specific integrated circuit or other integrated circuits, hardware/electronic logic circuits, such as a discrete element circuit, a programmable logic device, such as a programmable logic array, field programmable gate-array, or the like. In general, the controller 520 may be any controller or processor device or devices capable of operating an electronic device and implementing the disclosed embodiments.

Figure 6:
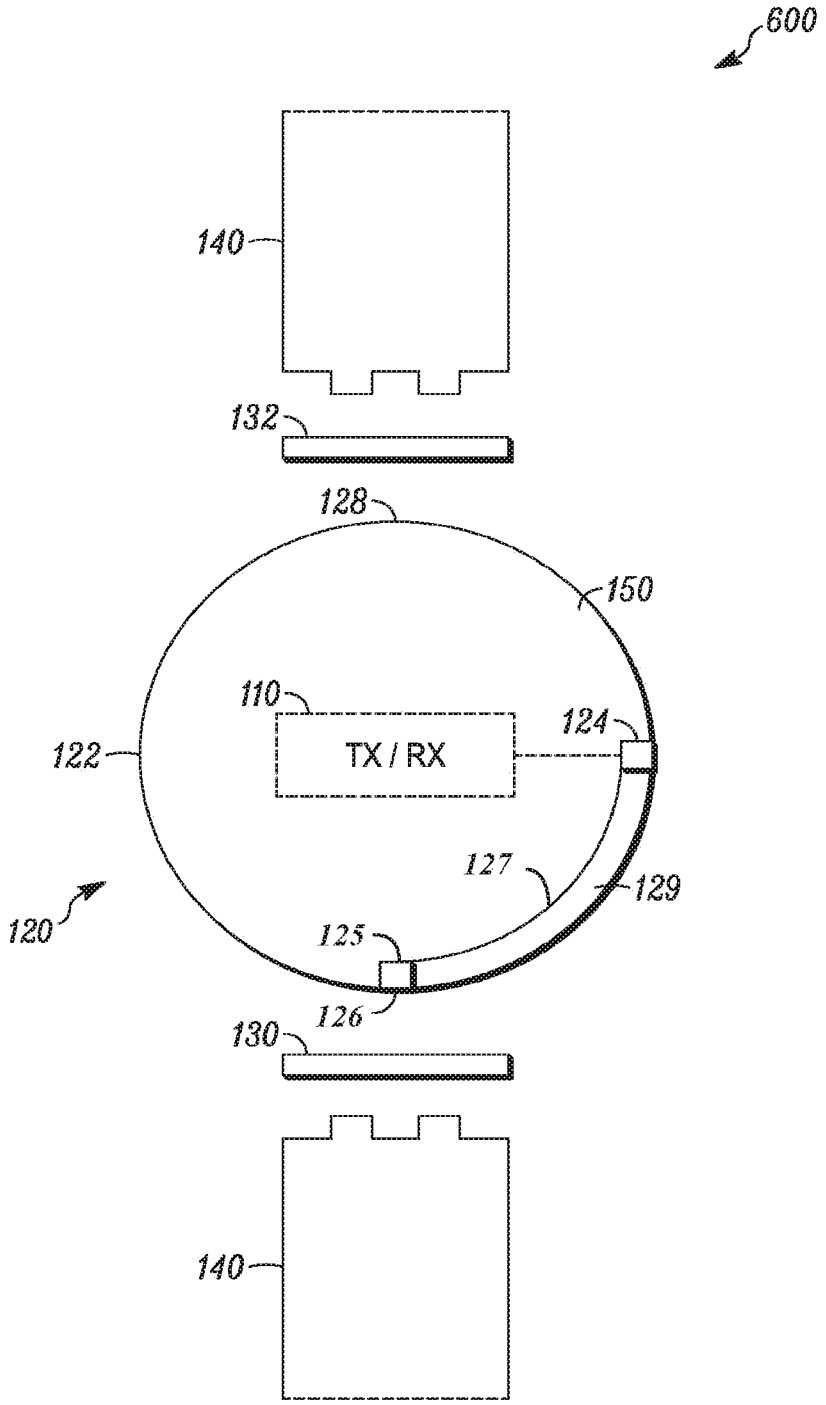
FIG. 6 is an example exploded view of an apparatus according to a possible embodiment.

FIG. 6 is an example exploded view of an apparatus 600 according to a possible embodiment. The apparatus 600 can include all of the elements of the apparatus 100 of FIG. 1 described above. According to this embodiment, the apparatus 600 can include an electrically conductive element 127, such as an electrically conductive ring and/or ground ring, coupled to the feed point 124. The apparatus 600 can also include an electrically conductive point 125, such as a ground point, that connects the electrically conductive element 127 to the housing 120, such as a front housing. The apparatus 600 can further include a printed circuit board 150 coupled to the feed point 124 and/or the ground point 125. The printed circuit board 150 can include the transceiver 110. A combination of or a subset of the feed point 124, the ground point 125, the housing 120, the electrically conductive element 127, and the printed circuit board 150 can define a radiating element. For example, the radiating element can be a slot antenna including a radiating aperture or slot 129. Additionally, the desired frequency of radiating aperture 129 operation and transmissions can define the length of the electrically conductive element 127.

According to a possible embodiment, the apparatus 600 can be a wearable apparatus. The apparatus 600 can include a transceiver 110. The apparatus 600 can include an electrically conductive housing 120. The transceiver 110 can be carried in the electrically conductive housing 120. The electrically conductive housing 120 can include at least a first wearable apparatus carrier device connection area 126, such as a watch band connection area, a lanyard connection area, a chest strap connection area, or any other connection area that connects a device to the apparatus 600 so the apparatus 600 can be worn by a user.

The apparatus 600 can include a radiating element 129 coupled to the electrically conductive housing 120. The radiating element 129 can be coupled to a feed point 124 that is coupled to the transceiver 110. The radiating element 129 can be a radiating aperture configured to radiate radio frequency signals. For example, the radiating element can be a watch housing radiating element, a tuned radiating element, a slot antenna or any other radiating element. As a further example, the apparatus 600 can be configured with an antenna system having a slot antenna. Some slot antennas are constructed from creating a narrow slot or space, such as the radiating aperture 129, in a metal surface and driving the metal surface such that the slot radiates electromagnetic waves. The slot length can be in the range of a half wavelength at the driven frequency. Although an opening is typically cut into a metal surface to create a typical slot antenna, in the instant case, first and second conductive surfaces, such as a surface of the housing 120, the printed circuit board 150, the electrically conductive element 120, or other conductive surfaces, of the apparatus 600 can be configured to create the radiating element space/aperture 129 that radiates electromagnetic waves with a substantially similar pattern to that of a slot antenna.

According to a possible embodiment, the apparatus 600 can include the electrically conductive element 127 electrically coupled to the feed point 124 and a slot antenna can be defined by the electrically conductive element 127 and the electrically conductive housing 120. The apparatus 600 can also include a ground point 125 connecting the electrically conductive element 127 to the electrically conductive housing 120. A slot antenna can be defined by the electrically conductive element 127, the feed point 124, the ground point 125, and the electrically conductive housing 120. The apparatus 600 can further include a printed circuit board 150 including electrically conductive material. A slot antenna can be defined by the electrically conductive element 127, the feed point 124, the ground point 125, the electrically conductive housing 120, and the printed circuit board 150. For example, a slot can be defined using the printed circuit board 150 including electrically conductive material, such as on its edge, and can further be defined using the electrically conductive element 127 as a ground ring, using the feed point 124, and using the outer housing 120. According to a possible embodiment, if the current isolation element 130 is not used, an electrically conductive wearable apparatus carrier device 140, such as the watch band 140 of FIG. 1, can put conductive material into an air gap that should be the slot, such as a radiating element 120, and this can redefine the slot for different operation than originally intended.

The apparatus 600 can include a current isolation element 130 coupled to the radiating element 129 at the first wearable apparatus carrier device connection area 126. The apparatus 600 can include an electrically conductive wearable apparatus carrier device 140 coupled to the electrically conductive housing 120 via the current isolation element 130. The current isolation element 130 can provide electrical isolation between the electrically conductive wearable apparatus carrier device 140 and the electrically conductive housing 120 and the radiating element 129. The current isolation element 130 can prevent contact between the electrically conductive wearable apparatus carrier device 140 and electrically conductive elements defining the radiating element 129. The current isolation element 130 can also minimize rotation of the electrically conductive wearable apparatus carrier device 140 with respect to the electrically conductive housing 120.

The electrically conductive wearable apparatus carrier device 140 is defined as a device that carries an apparatus, where the device is electrically conductive and the device is wearable. For example, the electrically conductive wearable apparatus carrier device 140 can be a watch band, an arm band, a bracelet, a lanyard, a belt, or any other electrically conductive device that a user can wear to carry a portable electronic device having a transceiver. Such an electrically conductive wearable apparatus carrier device typically connects to a portable electronic device housing using an electrically conductive connection or includes an electrically conductive portion inserted into a portable electronic device, such as the apparatus 600. The current isolation element 130 can reduce and/or eliminate the amount of electrically conductive wearable apparatus carrier device electrically conductive material that affects the radiating element 130. For example, the electrically conductive wearable apparatus carrier device 140 can include an electrically conductive portion inserted into the apparatus 600 that affects a slot antenna if inserted into the slot. The current isolation element 130 can reduce or eliminate the amount of electrically conductive material that affects the slot. The current isolation element 130 can isolate the electrically conductive wearable apparatus carrier device 140 enough from the electrically conductive housing 120 to minimize influence of the electrically conductive wearable apparatus carrier device 140 on the radiating element 129.

Figure 7:
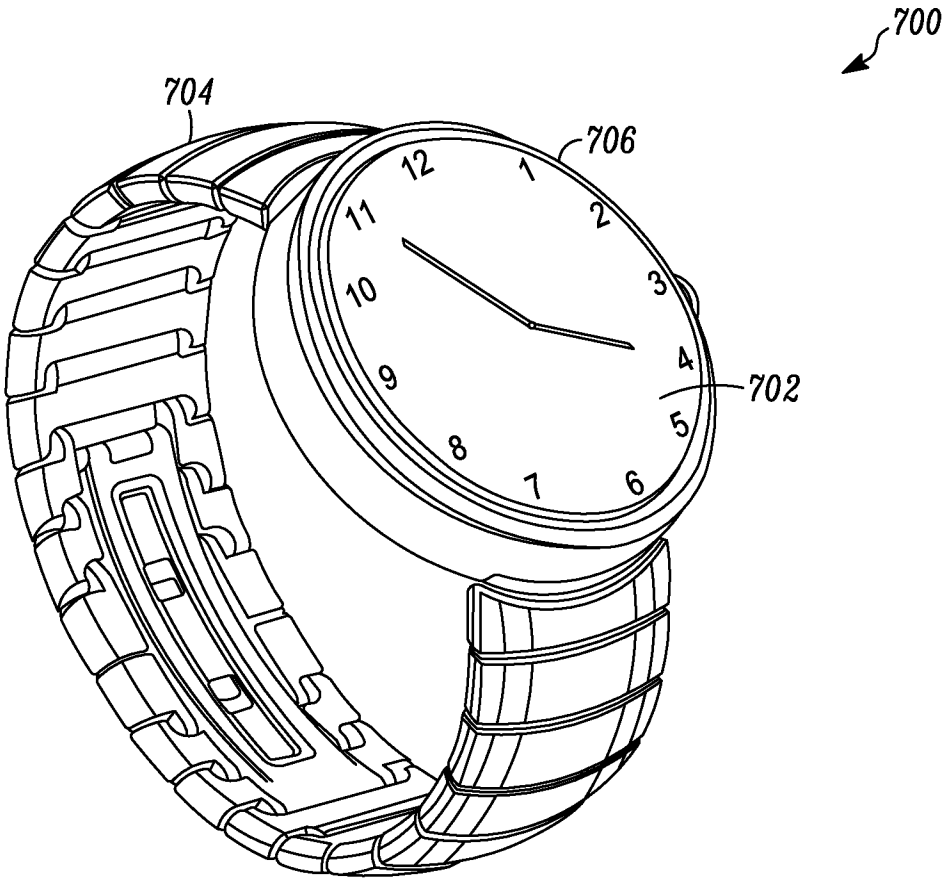
FIG. 7 is a diagram illustrating a wearable electronic device configured with an antenna system in accordance with a possible embodiment.

FIG. 7 illustrates a representative wearable electronic device 700 in which embodiments of an antenna system can be implemented. The wearable electronic device 700 includes a portable electronic device 706, such as the apparatus 100 of FIG. 1 and/or the apparatus 600 of FIG. 6, in this case a smartwatch, having a display assembly 702. The wearable electronic device 700 further includes a wearable element 704, such as the wearable apparatus carrier device/watch band 140, attached to the portable electronic device 706, in this case a wristband 704, which allows the portable electronic device 706 to be worn on a person's body. The wearable element 704 can be connected to the portable electronic device 706 via the current isolation element 130 (not shown in FIG. 7) of FIG. 1. The present disclosure refers to a smartwatch or wrist-worn electronic device to illustrate embodiments of the antenna system. However, the antenna system and method for assembling a wearable electronic device that includes the antenna system, described herein, can be applied to any electronic device that can operate using an antenna. Such devices include, but are not limited to: other types of wearable electronic devices such as eyewear that incorporates a portable electronic device; portable electronic devices for monitoring body functions such as heart rate monitors and pulse monitors; and other wearable electronic devices.

In the example smartwatch 700 of FIG. 7, the display assembly 702 is circular and can display information such as the current date and time, notifications, images, and the like. In the embodiment shown, the display assembly 702 is implemented as an analog watch-face that displays the current time using multiple rotating hour and minute pointers or hands that point to numbers arranged around a circumference of the display assembly 702. In other embodiments, the watch-face digitally displays information such as the current date and time as a sequence of alpha-numeric digits. In further embodiments, the display assembly 102 hosts a user interface through which the smartwatch 700 can be configured and controlled. In yet other embodiments, the display assembly 702 has another shape, such as square, rectangular, oval, etc.

Figure 8:
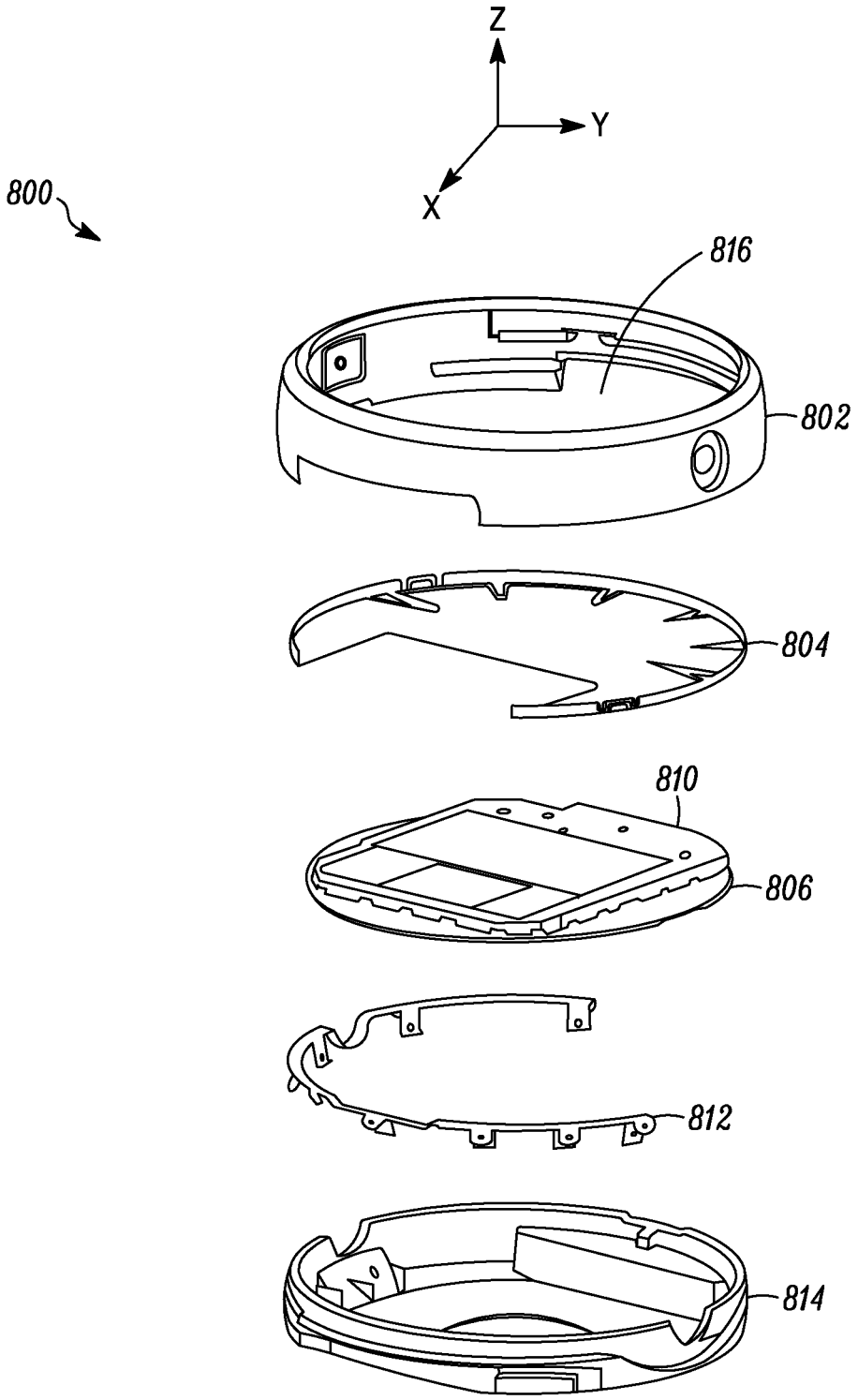
FIG. 8 illustrates an exploded view of various components of a wearable electronic device configured with an antenna system in accordance with a possible embodiment.

FIGS. 8-14 illustrate different views of an electronic device, such as the smartwatch 700, that incorporates the present teachings. Therefore, when describing FIGS. 8-14, reference will be made specifically to the smartwatch 700 shown in FIG. 7, although the principles described can be applied to other types of electronic devices. In FIG. 8 some components 800 the smartwatch 700 are shown in an exploded view. Illustratively, the smartwatch 700 incorporates the components 800 in a "stack," wherein a plurality of internal components including a display bezel 804, a printed circuit board (PCB) 806, a shield 810, and a contact element 812 are stacked or layered on top of one another and enclosed within a cavity of front 802 and rear 814 outer housing components, such as components of the housing 120 of FIG. 1. Front and rear housing components are also referred to herein as front and rear housing. As shown, the components 802, 804, 806, 810, 812, and 814 are stacked along a Z axis, which is also referred to herein and in the claims as a first axis. FIG. 8 shows one illustrative layering or stacking of the components 800 of the smartwatch 700. In other embodiments, however: some of the components 800 are disposed in different locations of the stack; major components are combined into a unitary component; and other components, not shown in FIG. 8, are included to accomplish specific tasks.

Further to the details of the illustrative component stack 800, the front housing component 802 has a cylindrical shape with a cavity in the center that is sufficiently deep to enclose or contain most or all of the internal components of the device 700. The front housing component 802 is constructed from a conductive material, such as any suitable metal, to enable a segment of the front housing component 802 to form part of an antenna system or antenna for short, in accordance with the present disclosure, for the smartwatch 700. Namely, a first conductive surface of the antenna is constructed from a portion of the front housing component 802.

The display bezel 804 is disposed between a display assembly (not shown in FIG. 8) and the PCB 806, and provides support for the display assembly after the device 700 is assembled. Also, when assembled, a lens or touchscreen of the display assembly extends through an opening 816 of the front housing component 802. An example display assembly includes a number of layers that are adhesively attached to the front housing 802. For example, layers of a liquid crystal display (LCD) assembly include, but are not limited to, polarizing films, glass substrates, and an LCD panel. Resistive touchscreens include, for instance, multiple electrically resistive layers. Capacitive touchscreens include multiple layers assembled to detect a capacitive impingement on the touchscreen.

Electronic components on the PCB 806 provide most of the intelligent functionality of the device 700. The PCB 806 illustratively includes electronic components, such as, one or more communication elements, e.g., transceivers, that enable wireless transmission and reception of data. One example PCB 806 also includes media-capture components, such as an integrated microphone to capture audio and a camera to capture still images or video media content. Various sensors, such as a PhotoPlethysmoGraphic sensor for measuring blood pressure, are disposed on some PCBs 806. Still other PCBs 806 have processors, for example one or a combination of microprocessors, controllers, and the like, which process computer-executable instructions to control operation of the smartwatch 700. In still other examples, the PCB 806 includes memory components and audio and video processing systems. In this example component stack, the shield 810 is positioned over the PCB 806 to protect the electronic components arranged on the PCB 806.

The contact element 812 is another component of the antenna system, for the electronic device 700, in accordance with the present teachings. For some embodiments, the antenna system is arranged as a slot antenna, wherein the contact element 812, such as the electrically conductive point 125 of FIG. 6, connects the first conductive surface of the antenna (that functions as a radiator) with a second conductive surface of the antenna (that functions as electrical ground), to drive the antenna. Further, the contact element 812 tunes the antenna based on how the contact element 812 is configured. An example contact element 812 is constructed from a conductive material, e.g., any suitable metal.

In an embodiment, the contact element 812 is configured to electrically connect the front housing 802, from which the first conductive surface of the antenna is constructed, to the printed circuit board 806, which is one contacting metal component of a second conductive surface of the antenna system for the device 700. In a particular embodiment, the display bezel 804 and the shield 810 are also contacting metal components that make up the second conductive surface. "Contacting" metal components or elements are internal components of a device that are physically connected or physically touch at some metal segment of the components to provide a continuous electrical connection along multiple conductive surfaces, for instance to provide an electrical ground for a slot antenna. A contacting metal component need not be constructed entirely of metal. Only the segment of the contacting metal component that makes up part of the second conductive surface needs to be constructed of metal.

The rear housing component 814 can be made of any suitable non-conductive or non-metallic material, with ceramic used in some embodiments and plastic used in other embodiments. Using a non-metallic material for the rear housing 814 prevents inadvertent electrical connections between the first and second conductive surfaces of the antenna, which would negatively impact the antenna's functionality. In one particular embodiment, the wristband 704 (see FIG. 7) or other wearable element attaches to the rear housing 814 with wristband-attachment pins, such as bar 350 of FIG. 4, or via another well known mechanism. Housing-attachment pins are one possible mechanism for connecting the rear housing 814 to the front housing 802. In a further embodiment, a separate endplate (not shown) covers the rear housing 814.

As mentioned above, in one example, the device 700 includes an antenna system that can be configured to operate as or in accordance with principles of operation of a slot antenna. Namely, conventional slot antennas are constructed by creating a narrow slot or opening in a single metal surface and driving the metal surface by a driving frequency such that the slot radiates electromagnetic waves. For some implementations, the slot length is in the range of a half wavelength at the driving frequency.

By contrast, instead of an opening being cut into a single metal surface to create the slot antenna, the present teachings describe a space, gap or aperture (the effective "slot") located between first and second conductive surfaces of an antenna system, wherein the antenna system can be configured to radiate electromagnetic waves at a desired frequency through this slot, also referred to herein as a radiating slot. In essence, an antenna system in accordance with the present teachings can be termed as a "slot" antenna since it can be configured to radiate, through the space or slot between the first and second conductive surfaces, electromagnetic waves having a substantially similar pattern to the electromagnetic waves radiated through the opening of a conventional slot antenna. More particularly, in accordance with an embodiment, the antenna system can be configured with an aperture between the first and second conductive surfaces that has a length that is in the range of a half wavelength at the driving frequency.

Figure 9:
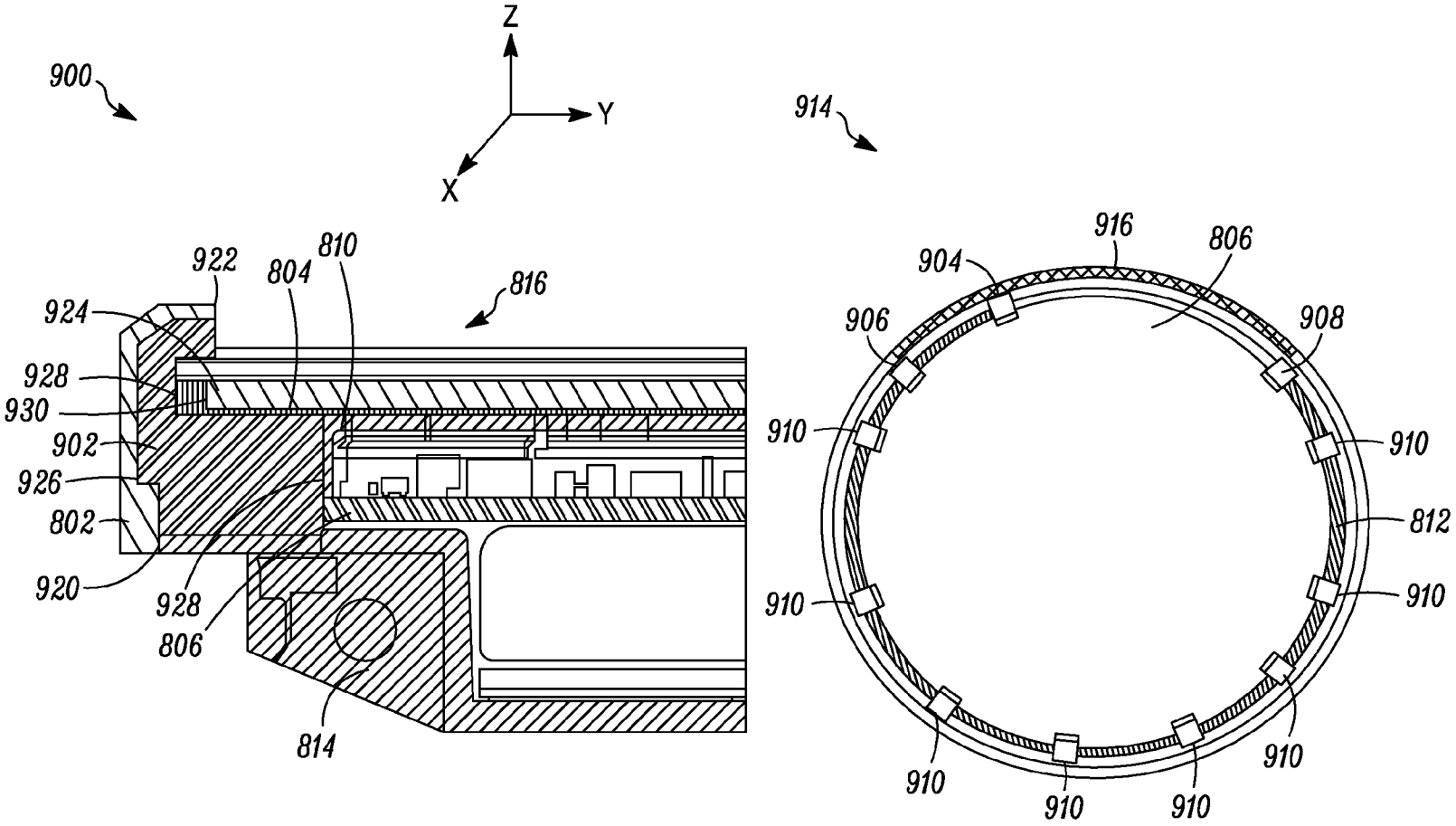
FIG. 9 illustrates a cross-sectional view and a plan view of components of a wearable electronic device configured with an antenna system in accordance with a possible embodiment.

FIG. 9 shows a cross-sectional view 900 of the components 802, 804, 810, 806, and 814 when the smartwatch 700 is assembled. More specifically, when assembled, the front housing component 802 is connected to the rear housing component 814 at a first edge 920 of the front housing component 802. The front 802 and rear 814 housing components may also be connected at areas other than the edge 920. The opening 816 of the front housing component 802 is at a second opposing edge 922 of the front housing component 802. The front and rear housing components 802, 814 at least partially enclose the internal components, e.g., 804, 806, 810, and 812, of the device 700.

The internal components also include a display 924 that spans the opening 816 of the front housing component 802. As used herein, a "display" of a display assembly is the element or panel, for instance an LCD panel or capacitive element panel, upon which pixels of an image or picture, video, or other data are shown. Properties of the display 924 are described in greater detail in relation to FIG. 13. A surface spans an axis or opening when the surface extends over or across the axis or opening in the same direction of the axis or opening. A first surface spans a second surface when the first surface extends at least partially over or across the second surface in the same direction as the second surface, wherein there is at least some overlap between the two surfaces. It should be noted that for one surface to span another surface, the two surfaces need not be directly adjacent to one another. Similarly, for a surface to span an opening, the surface need not be directly adjacent to the opening.

Illustratively, an edge 930 of the surface of the display 924 aligns with the second edge 922 of the front housing component 802. Thus, the display 924 spans the opening 816 such that there is no mask positioned between edges of the display 924 and the second opposing edge 922 of the front housing component 802. Accordingly, when a user views the electronic device 700 from above, the display 924 can be configured to display images in a region that spans the full area of the opening 816, which beneficially provides for a device that has an edge-to-edge display.

The cross-sectional view 900 further illustrates an antenna system, in accordance with the present teachings, having first 926 and second 928 conductive surfaces that are separated by a space 902 that can radiate electromagnetic waves as a slot antenna. In this example, the first conductive surface 926 is constructed from a segment of outer housing of the wrist-worn electronic device 700. In a particular embodiment, the first conductive surface 926 for the antenna system is formed using an inner surface of the front housing component 802. In this case, the front housing component 802 has a cylindrical shape such that the segment of the outer housing from which the first conductive surface 926 is constructed is curved. Where the outer housing has a different shape, such as cuboid, the segment of the outer housing from which the first conductive surface 926 is constructed can have right angles.

Illustratively, the first conductive surface 926 is also seamless, meaning that the first conductive surface is a continuous piece of metal in an area where currents flow when the antenna system is operating, notwithstanding the continuous piece having openings for buttons and such. This seamlessness enables the current generated during the operation of the antenna system to be maintained within the inner surface of the front housing component 802, as opposed to escaping through a discontinuity in the housing component. This allows more efficient operation of the antenna system. As further illustrated in the cross-sectional view 900, the first conductive surface 926 spans a first axis, which in this case is the Z axis, through the electronic device 700. In relation to the display 924, which has a surface that spans the X and Y axes, the first conductive surface 926 is disposed normal to the surface of the display 924.

Also illustrated in cross-sectional view 900, the second conductive surface 928 is constructed from a set of contacting metal components that are internal to the electronic device. As used herein, a set includes one or more of a particular item. As mentioned above, in this case, the second conductive surface 928 is constructed from the set of contacting metal components which includes the internal components of the PCB 806, the shield 810, and the display bezel 804. In this embodiment, the second conductive surface 928 is constructed from adjacent contacting metal surfaces of each of the internal components 804, 806, and 810.

Particularly, the PCB 806 is disposed adjacent to, in this case directly adjacent to, the rear housing component 814. The shield 810 is disposed directly adjacent to the PCB 806. The display bezel 804 is disposed directly adjacent to the shield 810 and the display 924. Two items that are adjacent to each other are near or in the vicinity or proximity of each other. Directly adjacent items contact one another in at least one location. Accordingly, the second conductive surface 928 that is formed from the contacting metal segments of the adjacent internal components 804, 806, and 810 is also disposed along the Z axis normal to the surface of the display 924.

A properly performing antenna radiates, meaning communicates by sending and/receiving, radio waves (also referred to herein as signals) in a desired frequency range, referred to herein as the desired radiating frequency or the radiating frequency of the antenna, using a radiating structure that is driven by at least one feeding element. The antenna further suppresses one or more undesired or unwanted radiating frequencies, referred to herein as frequencies outside the desired radiating frequency, using at least one suppression element. In some embodiments, the contact element 812, such as the electrically conductive element 127 including the feed point 124 of FIG. 6, is configured to perform the functions of setting and feeding the desired radiating frequency and suppressing unwanted frequencies.

FIG. 9 illustrates an overhead view 914 of the device 700 showing an example contact element 812 in accordance with the present teachings. The view 914 omits many of the components of the device 700 shown in the cross-sectional view 900 to focus on the contact element 812 in the context of the device 700 as a whole. As shown, the contact element 812 includes a plurality of legs 904, 906, 908, and 910, which are also referred to herein as extensions. In some embodiments, the extensions 904, 906, 908, and 910 connect the first electrical conductor 926 to the second electrical conductor 928 at different location along the PCB 806 and the front housing component 802. Moreover, the extensions 904, 906, 908, and 910 have a substantially similar construction, but perform different functions. Namely, the extension 904 operates as a feeding element; the extensions 906 and 908 operate as frequency setting elements, and the extensions 910 operate as frequency suppression elements, as explained in further detail below. Further, the extensions 904, 906, 908, and 910 define physical characteristics of an antenna system for the device 700, in accordance with the present teachings.

For one embodiment, the extensions 904, 906, 908, and 910 define physical characteristics of a slot antenna having a radiating slot 916, such as the radiating element 129 of FIG. 6, formed between the first 926 and second 928 conductive surfaces. During operation, the antenna system radiates electromagnetic waves through the radiating slot 916 at the desired radiating frequency. The length of the radiating slot 916 affects the radiating frequency at which the antenna operates and is defined by the position of the legs 906 and 908. Particularly, the leg 906 is located coincident with a first end of the radiating slot 916, and the leg 908 is located coincident with a second end of the radiating slot 916. Accordingly, the legs 906 and 908 operate as first and second frequency setting elements the locations of which control the radiating frequency for the slot antenna having the slot 916.

In other examples, the frequency setting elements 906 and 908 are located closer or further apart, which changes the length of the slot 916, thereby, changing the radiating frequency of the slot antenna. The feeding element 904 is illustratively located between the first and second legs 906 and 908 and functions to drive the first conductive surface 926, which operates as a radiating structure, to generate and radiate radio waves at the desired radiating frequency through the slot 916.

Similar to some other antenna structures, an antenna in accordance with the present teachings operates in a particular frequency range. If the antenna emanates signals outside of this frequency range, the effectiveness of the antenna is compromised. Thus, such undesired frequencies should be suppressed. Accordingly, in an embodiment, the contact element 812 includes the set of frequency suppression elements 910, which operate to suppress one or more undesired radiating frequencies. Particularly, the frequency suppression elements 910 minimize the space between the first 926 and second 928 conductive surfaces in circumferential areas of the device 700 other than the slot 916 to, thereby, minimize the radiation of frequencies that are not within the range of operating frequencies for the antenna. Although in this embodiment eight frequency suppression elements 910 are shown, in other embodiments the device 700 includes more or fewer frequency suppression elements 910. Further, locations of the frequency suppression elements 910 may vary relative to one another in different embodiments depending on which frequencies are to be suppressed.

Figure 10:
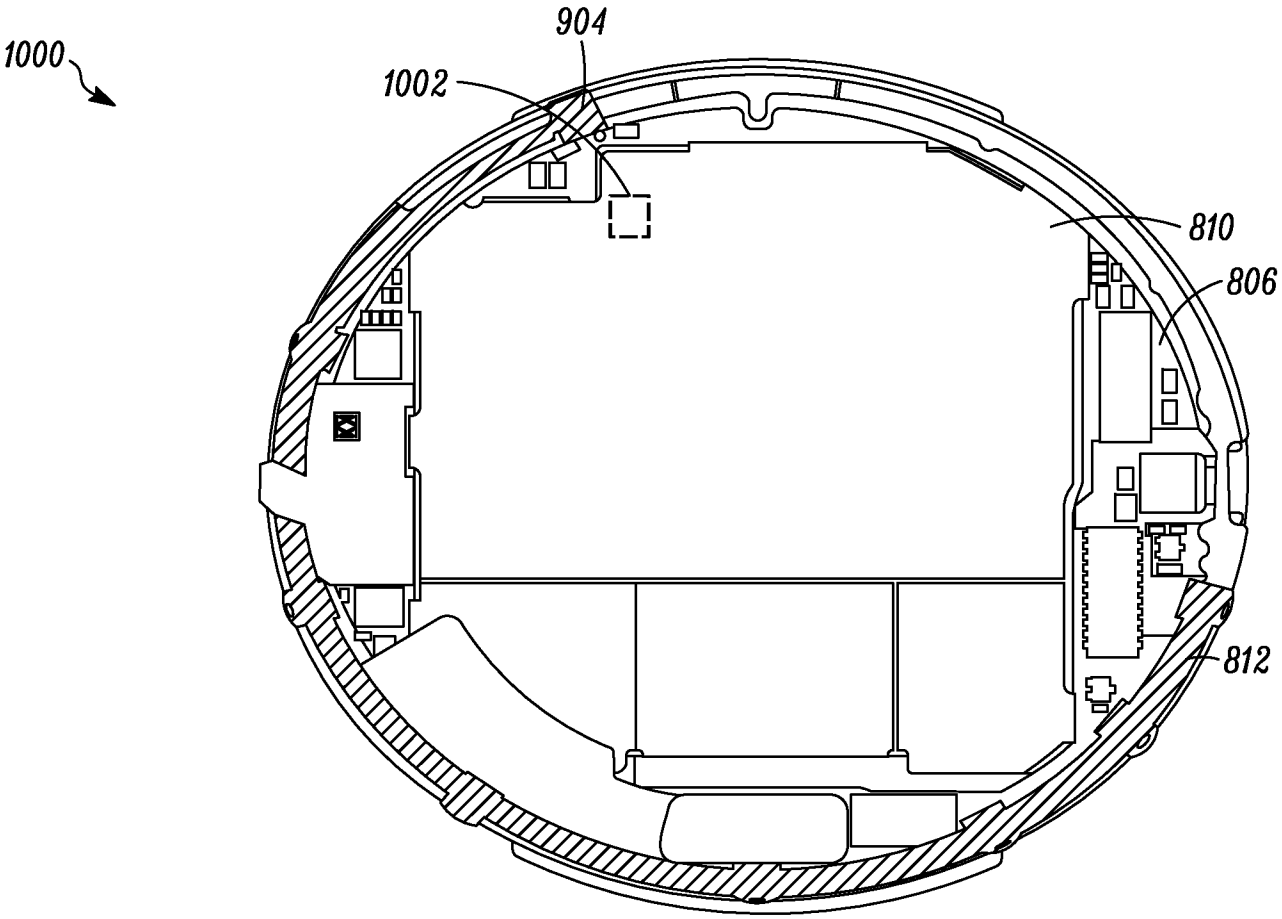
FIG. 10 illustrates another plan view of components of a wearable electronic device configured with an antenna system in accordance with a possible embodiment.

FIG. 10 illustrates a plan view 1000 of the device 700 looking down through the opening 816 of the outer housing 802. The view 1000 shows the contact element 812, the PCB 806 with various electronic components arranged thereon, and the shield 810. In one example, the components arranged on the PCB 806 include a wireless transceiver 1002 disposed near the feeding element 904. The wireless transceiver 1002 communicates device data using the feeding element 904. Namely, the feeding element 904 is electrically connected to the wireless transceiver 1002, for instance using metal traces that are not shown. The feeding element 904 also connects to the first conductive surface 926, which is constructed from the outer housing 902. The first conductive surface 926 operates as a radiating element to communicate wireless signals carrying device data between the wireless transceiver 1002 and wireless transceivers of external devices.

The wireless transceiver 1002 is configured with hardware capable of wireless reception and transmission using at least one standard or proprietary wireless protocol. Such wireless communication protocols include, but are not limited to: various wireless personal-area-network standards, such as Institute of Electrical and Electronics Engineers ("IEEE") 802.15 standards, Infrared Data Association standards, or wireless Universal Serial Bus standards, to name just a few; wireless local-area-network standards including any of the various IEEE 802.11 standards; wireless-wide-area-network standards for cellular telephony; wireless-metropolitan-area-network standards including various IEEE 802.15 standards; Bluetooth or other short-range wireless technologies; etc.

Figure 11:
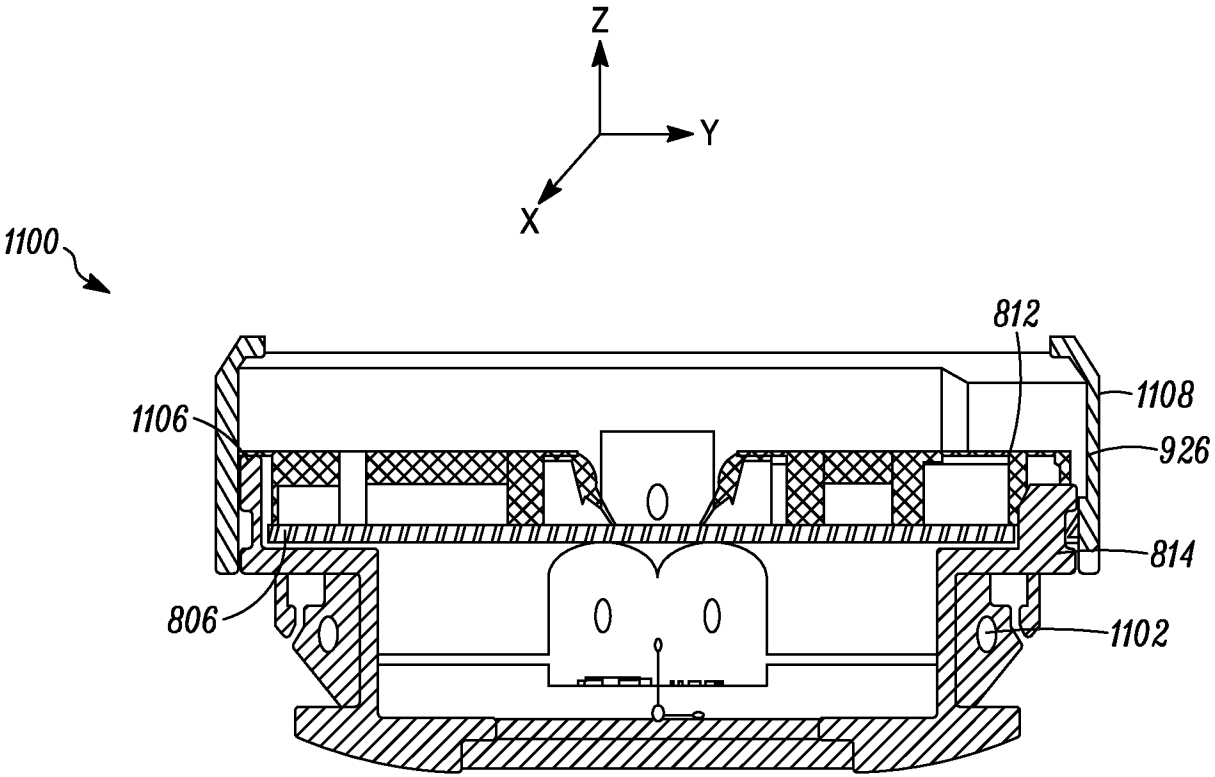
FIG. 11 illustrates another cross-sectional view of components of a wearable electronic device configured with an antenna system in accordance with a possible embodiment.

Turning now to FIG. 11, which illustrates a cross-sectional view 1100 of the device. During assembly of the device 700, the front housing 802 is engaged with the rear housing component 814 by applying forces along the Z axis which is substantially normal to a top surface of the PCB 806, which spans the X and Y axes. The cross-sectional view 1100 also illustrates that, in one example, the contact element 812 is disposed on an upper surface 1106 of the rear housing component 814.

View 1100 further shows that the first conductive surface 926 extends down to the rear housing component 814. Consequently, some embodiments of the electronic device can include a metal component, such as wristband 704, connected to an outside surface 1108 of the front housing component proximal to the first conductive surface 926. The metal component can further be proximal to a region, within the space between the first and second conductive surfaces, which contains current when the antenna system is operating without affecting the antenna's transmission properties as long as the metal component is not positioned such as to electrically short together the first and second conductive surfaces.

In one embodiment, the device 700 includes a receptacle 1102 configured to receive an attachment pin (not pictured). The attachment pin is shaped to fit a loop in the wristband 704 to hold the device 700 to a user's wrist. Depending on the embodiment, the attachment pin is made of metal, plastic, ceramic or another material suitable to hold the wristband 704 to the device 700. Also depending on the embodiment, the band 704 is made of metal, leather, or any other material capable of securely holding the device 700 to a user's wrist. Because currents of a slot antenna in accordance with the present teachings flow inside the slot area, objects made of metal or any other materials placed in contact with an external surface of the front housing 802 do not affect antenna performance. Thus, if the device 700 is fitted with a metal attachment pin and/or wristband, the antenna 916 maintains its transmission properties and thus there is no need to retune the antenna.

Figure 12:
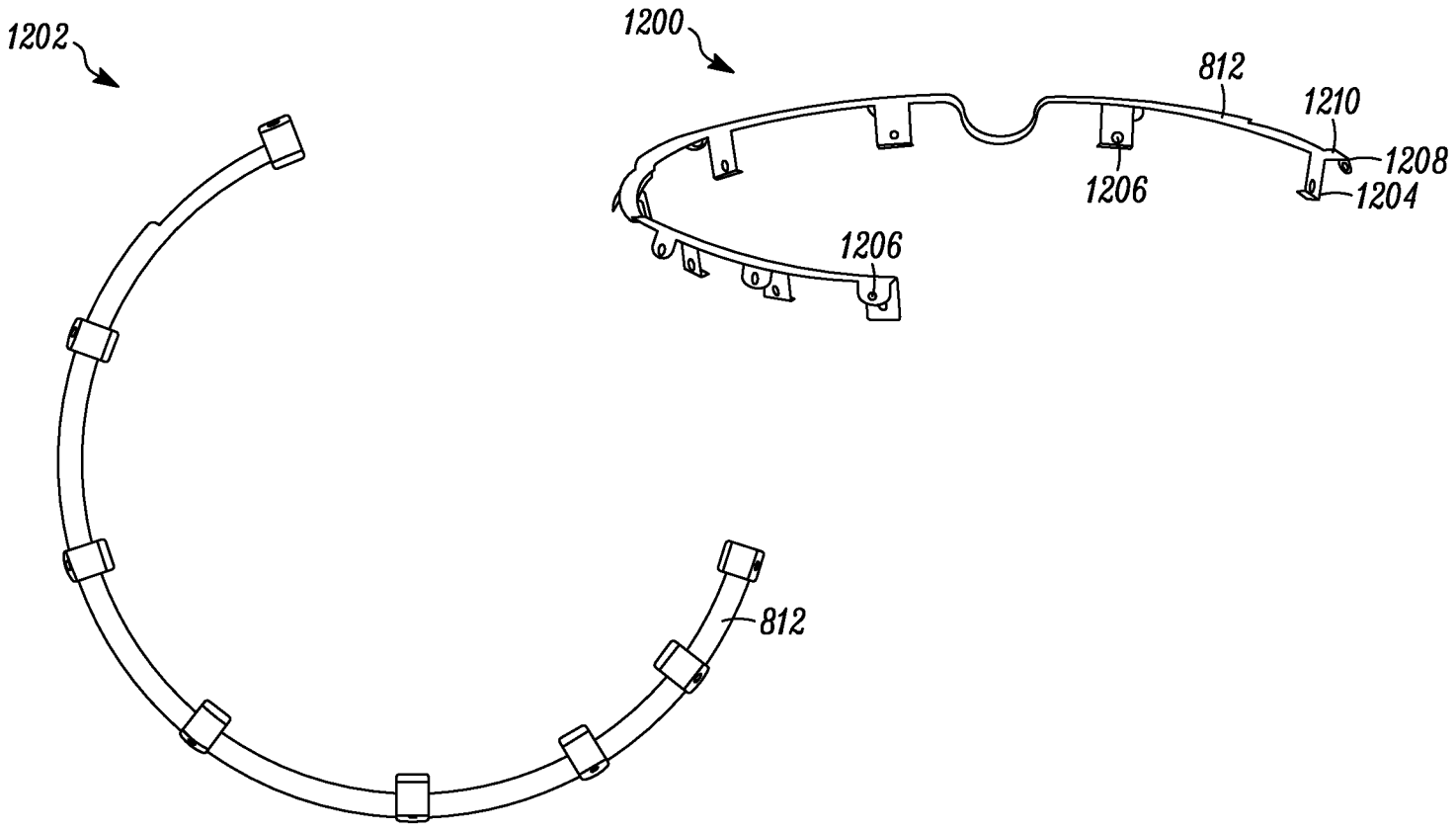
FIG. 12 illustrates two views of a contact element for an antenna system in accordance with a possible embodiment.

FIG. 12 shows two views 1200 and 1202 of the contact element 812 and its extensions 1210. As previously described, the extensions are configured to perform various functions including frequency setting and frequency suppression. The views 1200, 1202 illustrate that the contact element 812 is formed into a single piece of metal. Thus, as FIG. 9 in conjunction with FIG. 12 show, the first and second frequency setting elements 906 and 908 and at least one frequency suppression element 910 are constructed into a single piece of metal, such as the contact element 812. Further, the single piece of metal is curved. Because the contact element 812 is disposed on an upper edge 1106 of the rear housing 814 that is substantially concentric with the front housing component 802, the single piece of metal has a curvature that corresponds to a curvature of the outer housing 802 of the wearable electronic device 700. Further, the front housing component 802 has a cylindrical shape (see FIG. 8), and the contact element 812 has a semi-circular shape that conforms to the cylindrical shape of the front housing 802 and that sits within the rear housing component 814.

The extensions 1210 span downward from a top portion of the contact element 812 to form a "U" shaped piece, which is capable of receiving the upper edge 1106 of the rear housing 814. When the contact element 812 is disposed on the rear housing 814, a first side 1208 of the contact element 812 is positioned to contact the first conductive surface 926 and a second side 1204 is positioned to contact the second conductive surface 928.

Each of the first 1208 and second 1204 sides of the extensions 1210 have a spherical protrusion 1206 which serves as a contact point between the contact element 812 and other surfaces, such as the first 926 and second 928 conductive surfaces. When the device 700 is assembled, the front housing component 802 is positioned over the rear housing component 814 such that the extensions 1210 of the contact element 812 flex to connect the first conductive surface 926 to the second conductive surface 928, at least at the spherical protrusions 1206.

Figure 13:
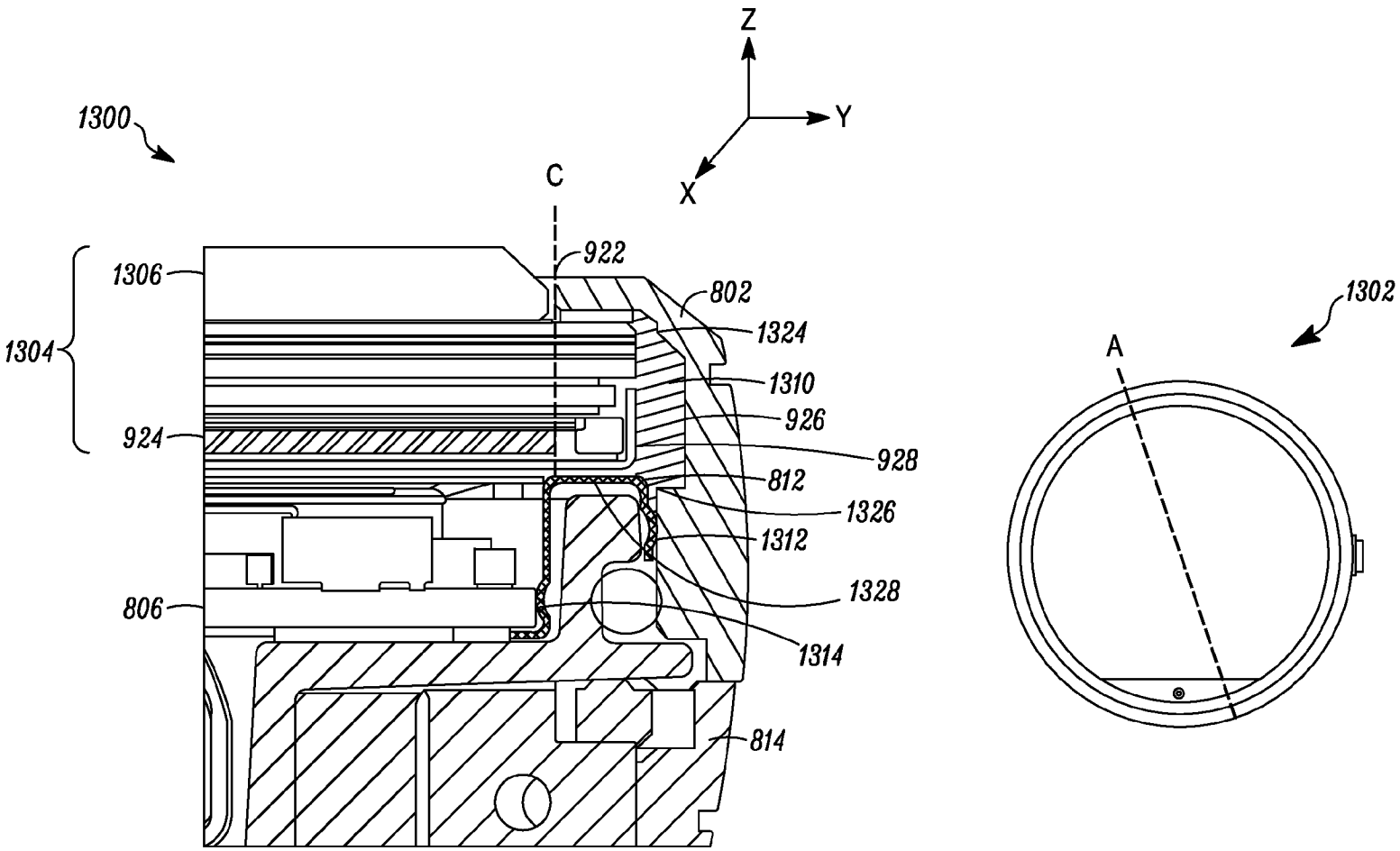
FIG. 13 illustrates a cross-sectional view and an overhead view of components of a wearable electronic device configured with an antenna system in accordance with a possible embodiment.

FIG. 13 illustrates views 1300 and 1302 showing aspects of the contact between the contact element 812 and the first 926 and second 928 conductive surfaces of the device 700. Views 1300 and 1302 also show the display 924 within a display assembly 1304, and the first 926 and second 928 conductive surfaces in greater detail. A location of a cross-section 'A' through the device 700 is illustrated in the overhead view 1302. The view 1300 shows a cut-away view of the device 700 at the cross-section 'A'.

The display assembly 1304 includes a lens 1306, the display 924, and other components, for instance various other layers as described above for an LCD display. The display 924 is configured to generate an image that is projected through the lens 1306 to a user of the device 700. The display 924 is arranged within the device 700 such that the edge 930 of the surface of the display 924 aligns with the second edge 922 of the front housing component 802. The alignment of the edge 930 of the display 924 with the second edge 922 is illustrated at 'C'.

View 1300 also shows a leg 1328 of the contact element 812, which represents a feeding element, a frequency suppression element, or a frequency setting element. When the contact element 812 is disposed on the lower housing 814 and the lower housing 814 is assembled with the front housing 802, the legs of the contact element 812 are compressed along one or both of the X and Y axes. This compression allows a feeding element, for instance, of the contact element 812 to connect the first conductive surface 926 to the second conductive surface 928 along a plane (in this case the X-Y plane) that is normal to the first conductive surface 926 (in this case the Z axis).

In one example, the leg 1328 is compressed to connect the first conductive surface 926 at a contact point 1312 and the second conductive surface 928 at another contact point 1314. The leg 1328 exerts a force in the X-Y plane to maintain the contact points 1312 and 1314 with the first 926 and second 928 conductive surfaces, respectively. In one particular example, the extension 1328 is a feeding element which connects at the contact point 1314 a segment of the PCB 806, which is one of the contacting metal components of the second conductive surface 928, to the first conductive surface 926 at the contact point 1312.

When the device is assembled, a space 1310, which illustratively forms portion of the slot antenna, is formed between the first conductive surface 926 and the second conductive surface 928. This space 1310 varies in size and dimension depending on in which cross-section of the device 700 the space 1310 is created. The variations in the size of the space between the first and second conductive surfaces sometimes differ because of the arrangement of the set of contacting metal components composing the second conductive surface 928 in spatial relationship to the first conductive surface 926. In other cases, a portion of the front housing component 802 has a different thickness at different locations, which affects the dimensions of the space 1310.

Figure 14:
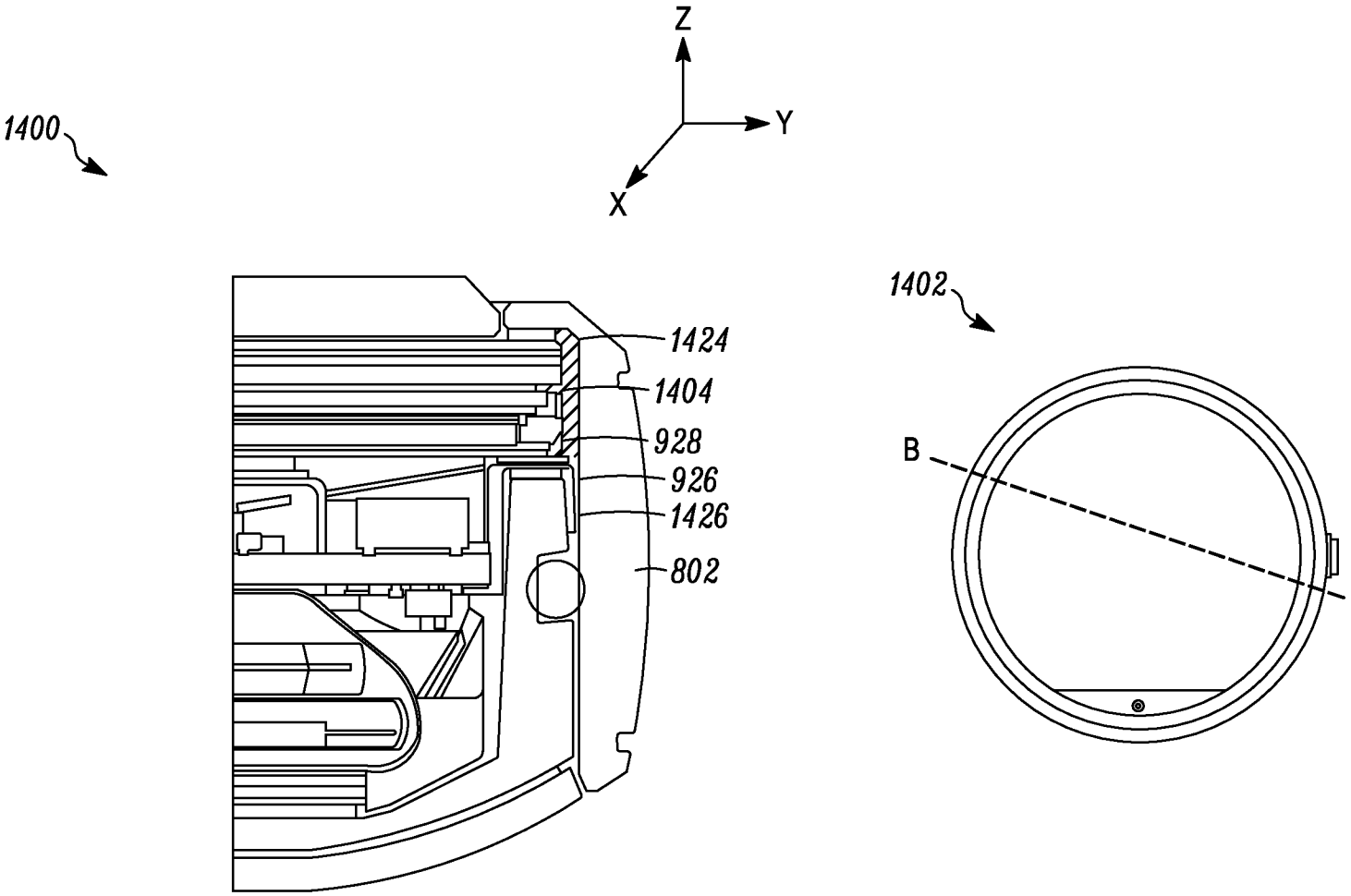
FIG. 14 illustrates another cross-sectional view and overhead view of components of a wearable electronic device configured with an antenna system in accordance with a possible embodiment.

FIG. 14 shows views 1400 and 1402 to allow the comparison of aspects of FIG. 14 with FIG. 13. A location of a cross-section 'B' through the device 700 is illustrated in the overhead view 1402. The view 1400 shows a cut-away view of the device 700 at the cross-section 'B'. Similar, to the cross-section illustrated in FIG. 13, the device 700 is configured to have a space 1404 between the first conductive surface 926 and the second conductive surface 928. The space 1404 illustrated in FIG. 14, however, is smaller than the space 1310 between the first 926 and the second 928 conductive surfaces illustrated in FIG. 13. The difference in the size of the space between the two conductive surfaces is attributable to a cut or core-out partially shown in FIG. 13. At cross-section 'A', a portion of the front housing 802 stretching from 1324 to 1326 is "cored-out" to facilitate communicating electromagnetic waves using the antenna system of the present teachings. This same region 1424, 1426 remains intact at cross-section 'B' illustrated in view 1400 to facilitate suppressing unwanted frequencies. Consequently the space 1310 between first conductive surface 926 and the second conductive surface 928 in view 1300 is larger than the space 1404 illustrated in view 1400. This change in the size of the spaces 1310, 1404 shows that at least one dimension of the space 1310, 1404 between the first 926 and second 928 conductive surfaces changes.

Figure 15:
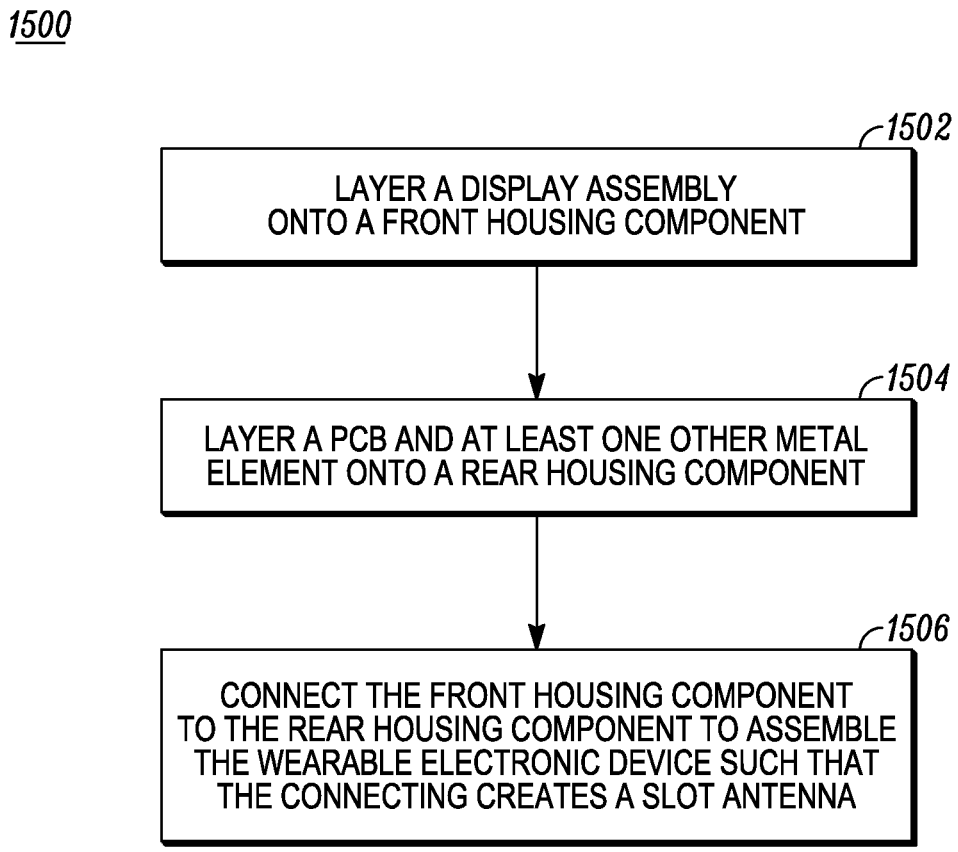
FIG. 15 shows a flow diagram illustrating a method for assembling a wearable electronic device having a slot antenna in accordance with a possible embodiment.

FIG. 15 illustrates is a method 1500 for assembling a wearable electronic device having a slot antenna. In one example, the method includes layering the contact element 812, the printed circuit board 806, and the display 924 onto at least one of the rear housing component 814 or the front housing component 802. In the particular embodiment illustrated by reference to method 1500, a display assembly, e.g., 1304 of FIG. 13, is layered 1502 onto and bonded to the front housing component 802. Moreover, the PCB 806 and at least one other metal component, for instance as shown in FIG. 8, is layered 1504 onto the rear housing component 814.

The method 1500 also includes connecting 1506 the front housing component 802 to the rear housing component 814 to assemble the wearable electronic device 700 such that a lateral surface of the front housing component 802 extends along the Z axis. The layering is performed in the Z axis which is normal to a face of the display 924. This layering entails applying forces along the Z axis to bring these components together. Connecting the front housing component 802 to the rear housing component 814 creates a slot antenna having an aperture 916 in accordance with the present teachings, for instance as described above by reference to FIGS. 7 to 14.

In the particular embodiment described by reference to FIGS. 7 to 14, layering the contact element comprises disposing adjacent to a cylindrical rear housing component 814 a semi-circular metallic ring 812 having formed therein the feeding element 904. Connecting the front housing component 802 to the rear housing component 814 comprises connecting a cylindrical front housing component 802 to the cylindrical rear housing component 814 to assemble a wrist-worn electronic device 700.

The disclosed device 700 illustrated a cylindrical front housing 802 with a circular face. In other embodiments, however, the front housing is configured with other shaped exteriors to present a front housing that is not cylindrical and a face that is not circular. For example, the front housing 802 disclosed herein can be configured, for example, with a square face that extends downward to blend with the cylindrical rear housing such that the housing is not perfectly cylindrical and the face is square. In still other embodiments, the housing and/or face is constructed with other shapes consistent with wearable electronic devices having different outer appearances.

Embodiments can provide for a device that includes a receptacle configured to receive an attachment pin. The attachment pin is shaped to fit a loop in a wristband to hold the device to a user's wrist. Depending on the embodiment, the attachment pin can be made of metal, plastic, ceramic or another material suitable to hold the wristband to the device. Also depending on the embodiment, the band is made of metal, leather, or any other material capable of securely holding the device to a user's wrist. If the band is electrically conductive, an isolation element can isolate the band from a device antenna radiating element.

Embodiments can provide for minimizing problems of a user wearable electrically conductive band affecting a radiating element, such as an antenna. Embodiments can also provide for an isolation element that provides more flexibility in the design of the device antenna and the device housing, without the designer having to worry about the user wearable electrically conductive band type.

In one embodiment, the apparatus is designed to minimize antenna performance challenges between the radiating element, such as an antenna, and the electrically conductive wearable apparatus carrier device, such as a metal band. However, even with that design, if the metal band is within the slot region, antenna performance can be degraded. For instance, a metal band in the slot region of the antenna that shorts to the housing can degrade antenna performance. For example, a watch type device can include a receptacle configured to receive an attachment pin. The attachment pin is shaped to fit a loop in the wristband to hold the device to a user's wrist. Depending on the embodiment, the attachment pin is made of metal, plastic, ceramic or another material suitable to hold the wristband to the device. By including the isolator, which is not electrically conductive, the designer can have more flexibility in designing the watch or other apparatus and selecting the materials without concern for impacting the antenna performance.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the disclosed embodiments. For example, one of ordinary skill in the art of the disclosed embodiments would be enabled to make and use the teachings of the disclosure by simply employing the elements of the independent claims. Accordingly, embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. The phrase "at least one of" followed by a list is defined to mean one, some, or all, but not necessarily all of, the elements in the list. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising." Furthermore, the background section is written as the inventor's own understanding of the context of some embodiments at the time of filing and includes the inventor's own recognition of any problems with existing technologies and/or problems experienced in the inventor's own work.

We claim:

1. A wearable apparatus comprising:

a transceiver;

an electrically conductive housing, the transceiver carried in the electrically conductive housing, the electrically conductive housing including at least a first wearable apparatus carrier device connection area;

a radiating element connected to the electrically conductive housing, the radiating element coupled to a feed point that is coupled to the transceiver, and the radiating element configured to radiate radio frequency signals wherein the radiating element forms at least a portion of a slot antenna and wherein a slot of the slot antenna is defined by an electrically conductive element within the conductive housing and the electrically conductive housing;

a current isolation element; and an electrically conductive wearable apparatus carrier device coupled to the electrically conductive housing via the current isolation element, where the current isolation element provides electrical isolation between the electrically conductive wearable apparatus carrier device and the radiating element.

2. The apparatus according to claim 1, wherein the electrically conductive housing comprises a watch housing and the radiating element includes at least a portion of the watch housing.

3. The apparatus according to claim 1, wherein the isolation element is positioned adjacent to the slot.

4. The apparatus according to claim 1, wherein the isolation element extends into the slot.

5. The apparatus according to claim 1, further comprising a ground point connecting the electrically conductive element to the electrically conductive housing, wherein the slot antenna is defined at least by the electrically conductive element, the feed point, the ground point, and the electrically conductive housing.

6. The apparatus according to claim 5, further comprising a printed circuit board including electrically conductive material, wherein the slot antenna is defined at least by the electrically conductive element, the feed point, the ground point, the electrically conductive housing, and the printed circuit board.

7. The apparatus according to claim 1, wherein the current isolation element comprises a first current isolation element, wherein the first wearable apparatus carrier device connection area comprises a first watch band connection area, wherein the electrically conductive housing further comprises a second watch band connection area on an opposite side of the electrically conductive housing from the first watch band connection area wherein the electrically conductive wearable apparatus carrier device comprises a electrically conductive watch band coupled to the electrically conductive housing via a second current isolation element at the second watch band connection area, where the second current isolation element provides electrical isolation at least between the electrically conductive watch band and the electrically conductive housing.

8. The apparatus according to claim 1, wherein the current isolation element prevents contact between the electrically conductive wearable apparatus carrier device and the electrically conductive element and radiating element defining the radiating element.

9. The apparatus according to claim 1, wherein the current isolation element secures a side of the wearable apparatus carrier device against a wall section in the housing to control rotation of the wearable apparatus with respect to the electrically conductive housing.

10. The apparatus according to claim 1, wherein the electrically conductive housing includes a housing pocket comprising the first wearable apparatus carrier device connection area, where at least the current isolation element is inserted into the housing pocket.

11. The apparatus according to claim 10, wherein the electrically conductive wearable apparatus carrier device is connected to the current isolation element, and an electrically conductive portion of the electrically conductive wearable apparatus carrier device is not inserted into the housing pocket.

12. The apparatus according to claim 10, wherein the electrically conductive wearable apparatus carrier device is inserted in the isolation element within the housing pocket.

13. The apparatus according to claim 10, wherein the electrically conductive housing includes at least one wall section within the housing pocket, and wherein a current isolation element side of the current isolation element and an electrically conductive wearable apparatus carrier device side are shaped to contact the at least one wall section upon rotation when coupled in the housing to limit rotation with respect to the electrically conductive housing.

14. The apparatus according to claim 13, wherein the at least one wall section, the current isolation element side, and the electrically conductive wearable apparatus carrier device side are substantially flat.

15. The apparatus according to claim 1, wherein the housing and components carried within the housing define an antenna slot, and the current isolation element extends into the slot when the carrier device is connected to the housing.

16. The apparatus according to claim 1, wherein the electrically conductive housing comprises a first conductive surface constructed from a segment of the electrically conductive housing, wherein the first conductive surface spans a first axis through the apparatus, and wherein the radiating element is part of an antenna including:

the first conductive surface;

a second conductive surface that spans the first axis, wherein the second conductive surface is constructed from the electrically conductive element that includes a set of contacting metal elements that are internal to the apparatus, wherein the first and second conductive surfaces are separated by a space; and a contact element having the feed point that connects the first conductive surface to the second conductive surface along a plane that is normal to the first conductive surface.

17. An apparatus comprising:

a transceiver;

a radiating element including a feed point coupled to the transceiver;

a watch housing including a front watch housing, the front housing comprising electrically conductive material, the front housing covering the transceiver and the radiating element, the watch housing including a back watch housing coupled to the front watch housing, the watch housing including a first watch band connection area on one side of the watch housing, and the watch housing including a second watch band connection area on an opposite side of the watch housing from the first watch band connection area;

a first current isolation element coupled to housing near the radiating element at the first watch band connection area;

a second isolation element coupled to housing at the second watch band connection area; and an electrically conductive watch band coupled to the watch housing via the first and second current isolation element, where the current isolation elements isolate the electrically conductive watch band from the electrically conductive housing and space the electrically conductive portions of the watch band from the radiating element.

* * * * *